United States Patent [19]

Hoyt

[11] 4,306,359

[45] Dec. 22, 1981

[54] MATERIAL TREATMENT SYSTEM

[75] Inventor: Charles W. Hoyt, Belmont, Mass.

[73] Assignee: Wolverine Corporation, Methuen, Mass.

[21] Appl. No.: 120,256

[22] Filed: Feb. 11, 1980

[51] Int. Cl.[3] ..... F26B 17/26

[52] U.S. Cl. ..... 34/57 A; 34/57 B; 34/164; 34/182; 406/75

[58] Field of Search ..... 34/57 R, 57 A, 57 B, 34/10, 164, 182, 225, 233, 242; 406/73, 75; 432/15, 58

[56] References Cited

U.S. PATENT DOCUMENTS

| | | | |
|---|---|---|---|
| 2,055,940 | 9/1936 | Newhouse . | |
| 2,084,976 | 6/1937 | Puerner . | |
| 2,422,105 | 6/1947 | Lehrer . | |
| 3,060,590 | 10/1962 | Brown . | |
| 3,089,253 | 5/1963 | Evans . | |
| 3,161,483 | 12/1964 | Morris . | |
| 3,229,377 | 1/1966 | Hoyt . | |
| 3,593,971 | 7/1971 | Blackman . | |
| 4,109,394 | 8/1978 | Hoyt | 34/57 B |
| 4,201,499 | 5/1980 | Buske et al. | 34/57 A |

*Primary Examiner*—Larry I. Schwartz

[57] ABSTRACT

Material treatment apparatus includes a vibrating conveyor and a gas flow system for fluidizing particles on the conveyor as they move through the treatment zone. Containment structure extends along the length of each side of the treatment zone and includes a side wall surface portion affixed to and movable with the conveyor and a cooperating fixed structure with an edge closely adjacent but spaced from the surface portion that defines an elongated orifice extending along each side of the treatment zone. Gas flows through each orifice and downwardly along each side wall surface towards the treatment zone and provides effective containment action that prevents particles on the conveyor from passing laterally from the treatment zone.

10 Claims, 7 Drawing Figures

MATERIAL TREATMENT SYSTEM

This invention relates to systems for treating solid particulate material with a gaseous medium brought into heat exchange or other treating relation with the particles as they are conveyed through a treatment zone and more particularly to particulate material treatment systems suitable for use with transport mechanisms of the oscillatory conveyor or similar type.

Particulate material is advantageously treated by maintaining the particles in fluidized conditions by gas flow that is in heat exchange or other treating relation with the particles as they are transported through the particle treatment zone. Such systems find extensive use in the food industry for processing particles such as coffee beans, grain, cereal flakes, etc., and in other industries for promoting or retarding chemical reactions, for driving off absorbed gases or moisture or for otherwise conditioning granular, pulverulent and other particulate materials. In treatment apparatus as shown in U.S. Pat. Nos. 3,060,590, 3,229,377, and 4,109,394, for example, the particles to be treated are conveyed along a horizontal gas impervious surface and gas jets are directed downwardly towards the impervious surface, the impinging gas velocity being sufficient to fluidize the particles, for uniform conditioning treatment, the gas then being exhausted upward at markedly reduced velocity to minimize the entrainment of particles in the exhaust flow.

The combined action of vibratory motion of the transport surface with gas jet action is frequently used to effectively fluidize a bed of particles but such conjoint action often creates a cloud of dust or fines that is difficult to contain. In a treatment apparatus of this type, side wall retention structure, integral and vibrating with the transport surface, may extend along either side of the treatment zone and cooperate with fixed structure in a particle retention arrangement to contain particles in the treatment zone. A variety of containment arrangements have been proposed including baffle arrangements, liquid seals and sliding seals but such arrangements have not been completely satisfactory. Particles tend to escape through such seal arrangements, causing cleaning problems, which in the case of the food processing industry results in unacceptable, unsanitary conditions, and seal failure problems because of rapid wear, as in the case of the processing of abrasive particles.

The present invention provides improved material treatment apparatus that includes a conveyor for transporting particulate material through a treatment zone, and a system including a drive for imparting vertically reciprocatory motion to the conveyor together with a gas flow system for fluidizing particles on the conveyor as they move through the treatment zone. Containment structure extending along the length of each side of the treatment zone includes side wall structure affixed to and movable with the conveyor. Each side wall structure has a surface portion that extends the length of the treatment zone and that, together with a cooperating fixed structure with an edge closely adjacent but spaced from the surface portion, defines an elongated orifice extending along the length of each side of the treatment zone. Gas is flowed through each orifice and downwardly along each side wall structure towards the treatment zone for providing containment action effective to prevent particles on the conveyor from passing laterally from the treatment zone.

The invention provides an effective containment system which is particularly useful in connection with systems that process abrasive particles and the like. As the containment system is essentially frictionless, no increased load is imposed on the conveyor drive.

In a particular embodiment, each cooperating fixed structure include a fixed, elongated containment chamber that has a slot in its lower wall, and the surface portion of the cooperating conveyor side wall structure is a planar blade and extends up through the slot into the chamber so that its upper edge remains entirely within the chamber as it is driven in vertical reciprocatory motion by the conveyor drive. A suitable gas, typically air, is supplied to the containment chamber to maintain the pressure in that chamber slightly above atmospheric pressure, a pressure in the order of one-half inch of water providing effective containment. The material of the containment chamber is preferably of a softer metal than the cooperating planar portion of the side wall structure, and the elongated orifice preferably has a width of less than 0.5 millimeter. The downward air flow through each narrow orifice and along the inner surface of each vibrating blade provides effective particle containment action at gentle and modest gas flow rates in an economical system without adverse effect on the particle conditioning process.

Other features and advantages of the invention will be seen as the following description of a particular embodiment progresses, in conjunction with the drawings, in which.

DESCRIPTION OF PARTICULAR EMBODIMENT

Figure 1:
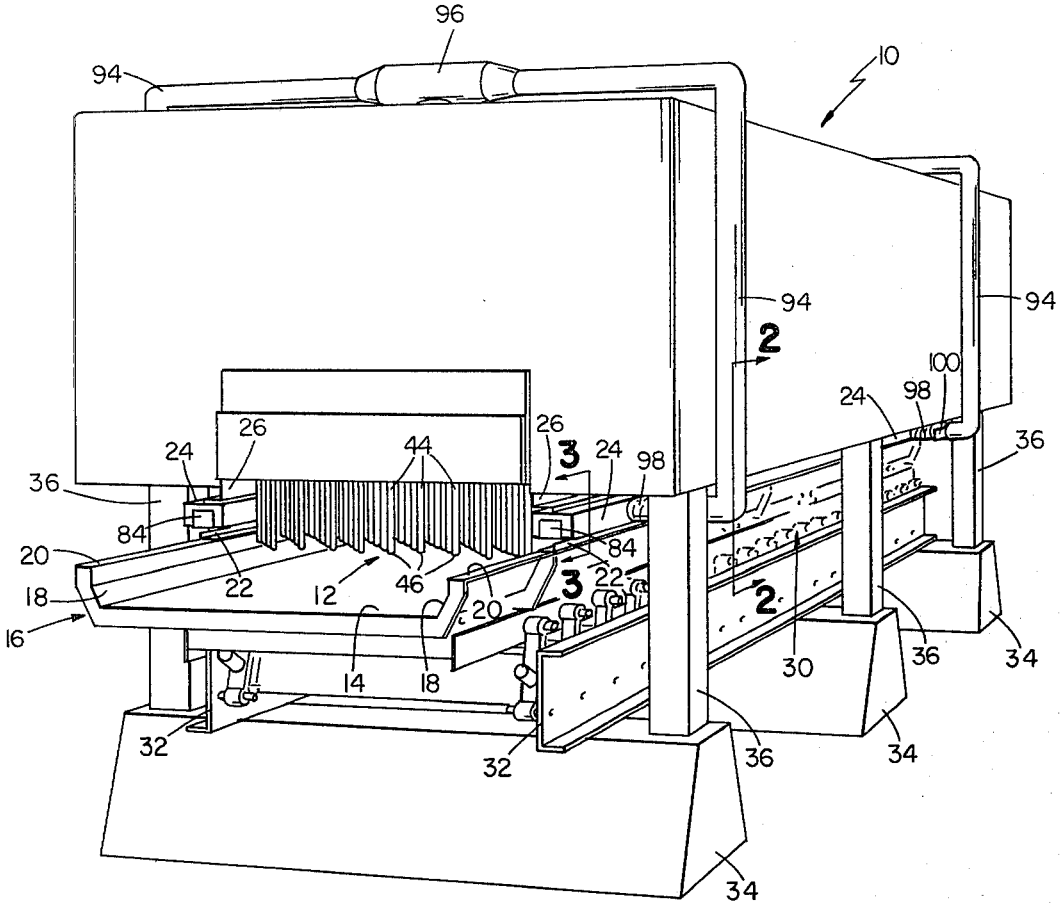
FIG. 1 is a perspective view of a particle treatment system in accordance with the invention.
Figure 2:
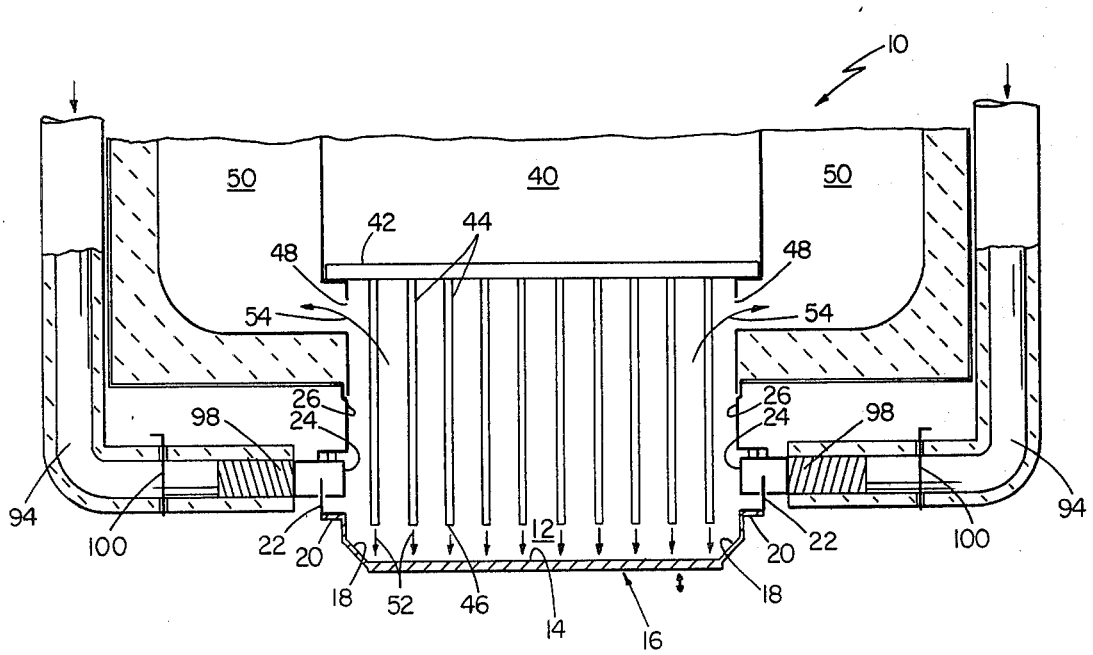
FIG. 2 is a cross-sectional view, taken generally along the line 2—2 of FIG. 1, of a portion of the apparatus shown in FIG. 1.

The particle treatment system shown in FIGS. 1 and 2 includes insulated housing 10 that is disposed above treatment zone 12, the bottom margin of which is defined by horizontal imperforate surface 14 of conveyor pan 16. In this embodiment the treatment zone is about 2½ feet in width and about twenty feet in length. The conveyor pan 16 has an open entrance end and a similar open discharge end. At each lateral edge of horizontal surface 14 is an inclined side wall 18 and a horizontal flange 20. Secured on each horizontal flange 20 is a containment member that includes a planar vertically extending blade 22. A cooperating containment structure 24 is supported above blade 22 from fixed side wall 26 of the treatment zone. Drive mechanism 30 imparts oscillatory motion of about one inch amplitude to the conveyor pan 16, and similarly to each blade 22. Longitudinal frame members 32 support the variable speed oscillator drive 30 and conveyor pan 16, and in turn, frame members 32 are supported on transverse foundation members 34. Columns 36 support housing 10 above conveyor pan 16.

As indicated in FIG. 2, disposed in housing 10 is a supply plenum 40. Extending downwardly from the base 42 of plenum 40 is an array of elongated tubes 44 that extends over the length and width of treatment zone 12. Each tube 44 has a diameter of three-quarter inch swaged to one-half inch diameter at its lower end and is twenty-two inches long. The tubes are arranged in a regular array with the tubes spaced on three inch centers in rows extending transversely of the array and with the transverse rows of tubes spaced lengthwise at two inches on center. The lower ends 46 of tubes 44 are typically spaced in the range of three to six inches from surface 14 of the conveyor pan.

In the upper portion of each side wall 26 is an elongated exhaust port 48 which communicates with an exhaust passage 50 that extends upwardly along the side wall of housing 10 to exhaust outlets at the top of the housing. The treatment gas, typically air, preferably flows through a recirculation path from exhaust passages 50 through a suitable filtering mechanism such as a cyclone, a blower, and conditioning equipment such as a heater or a cooler for return to supply plenum 40. The gas from supply plenum 40 flows downwardly through tubes 44 and into treatment zone 12 in an array of gas jets indicated by arrows 52. Gas is discharged upwardly from treatment zone at lower velocity for discharge through exhaust ports 48 as indicated by arrows 54.

Figure 3:
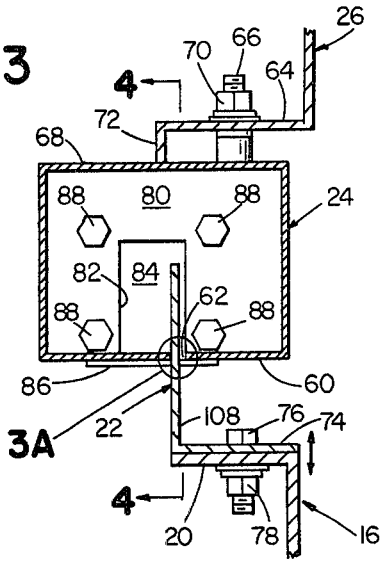
FIG. 3 is a sectional view taken along the line 3—3 of FIG. 1, of containment structure on one side of the conveyor.
Figure 4:
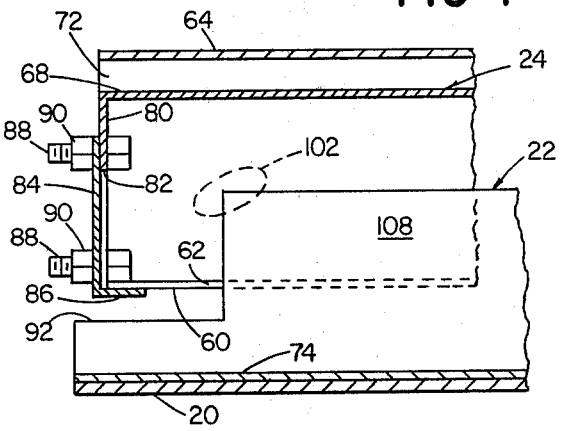
FIG. 4 is a section view taken along the line 4—4 of FIG. 3.
Figure 5:
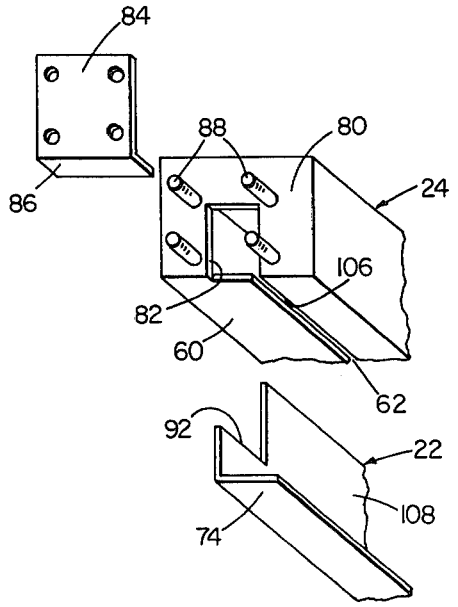
FIG. 5 is a perspective exploded view of the end portion of the containment structure shown in FIGS. 3 and 4.

Further details of the containment structure disposed along either side of particle treatment zone 12 may be seen with reference to FIGS. 3–5. Each containment chamber 24 is an elongated tubular box structure of fourteen gauge mild steel that has a width of four inches and a height of three inches. Formed in lower wall 60 of chamber 24 is a slot 62 that has a width of ⅛ inch. Each containment chamber 24 is supported from flange 64 of treatment zone side wall 26 by studs 66 that are welded to the top wall 68 of chamber 24 and cooperating stand off washers and nuts 70. Flange 64 has a stabilizing lip 72 that seats on the top wall 68 of chamber 24.

Secured to flange 20 of conveyor pan 16 by flange 74 is blade member 22 of twelve gauge (0.1054 inch thick) stainless steel. Blade 22 has a vertical height of three inches and is secured to flange 20 by bolts 76 and nuts 78.

Each containment chamber 24 has, at its end, an end wall 80 in which is formed a rectangular aperture 82, one edge of which is aligned with slot 62. End cap 84 has a flange 86 which overlies and encloses the end of each slot 62 and is secured on studs 88 which project from chamber end plate 80 by nuts 90. The end of each blade 22 has a rectangular cutout that provides a horizontal surface 92 about one inch above flange 74, as shown in FIGS. 4 and 5.

Insulated supply conduits 94 extend from a supply connection 96 at the top of housing 10 down along either side of the housing and are connected via flexible connector 98 to containment chambers 24. Each such connection is made at a point about three feet from the end of chamber 24. Gas flow through each supply conduit 94 is controlled by a slide gate 100 (FIG. 2).

Figure 3A:
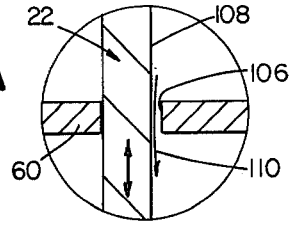
FIG. 3A is an enlarged view of a portion of FIG. 3.
Figure 6:
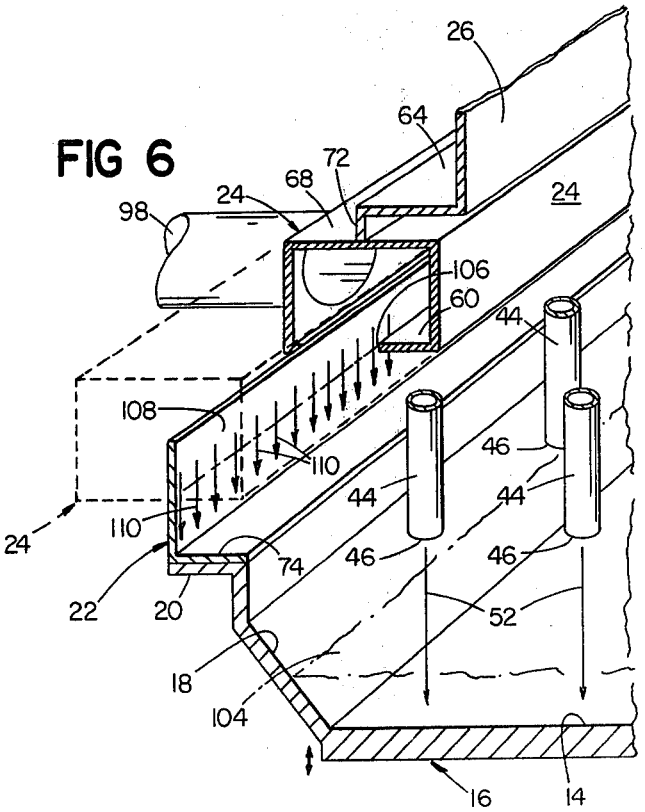
FIG. 6 is a diagrammatic perspective view indicating the nature of gaseous flows in the processing of particulate materials with the system shown in FIG. 1.

In operation, drive mechanism 30 imparts oscillatory motion at a frequency of about 250 cycles per minute and an amplitude of about one inch to conveyor pan 16 and attached containment blade 22 (the oscillatory motion being indicated by dashed line 102 in FIG. 4). Processing air from plenum 40 flows downwardly through tubes 44 and provides high velocity streams 52 which are directed perpendicularly downwards toward conveyor surface 14. The velocity of jets 52 is such that they tend to blow particles in bed 104 (FIG. 6) away from those areas of conveyor surface 14 directly beneath the jets. The jets 52 impact the impervious surface 14 and are deflected radially outwardly, and tend to pass under the particles in the bed 104 and lift them off the conveyor surface 14 in a fluidizing action. Concurrently, containment air flows through supply pipes 94 into containment chambers 24 to establish a pressure in each chamber at about one inch of water. Containment air flows continuously through each orifice defined by the inner edge 106 of slot 62 and the opposed inner surface 108 of blade 22 and downwardly along surface 108, as indicated by arrows 110 (FIGS. 3A and 6) to contain particles within treatment zone 12.

This containment system is of particular use in the processing of abrasive particles such as the drying of bauxite powders with a particle size of 30–40 mesh (595 micron to 420 micron) and a high percentage of smaller fines (typically varying from 1.9 micron to 125 micron size). The fines that float out of the treatment zone (through passages 50) are captured in dust collectors. The system provides a frictionless seal arrangement that effectively contains such abrasive particles within the treatment zone without imposing increased drive requirements on the conveyor system. Various gas flow arrangements and containment structure configurations may be employed depending on particular applications.

While a particular embodiment of the invention has been shown and described, various modifications will be apparent to those skilled in the art and therefore it is not intended that the invention be limited to the disclosed embodiments or to details thereof and departures may be made therefrom within the spirit and scope of the invention.

What is claimed is:

1. A material treatment system comprising a conveyor having a transport surface for transporting particulate material through a treatment zone, a drive for imparting vertical reciprocatory motion to said transport surface, a gas flow system for fluidizing particles on the transport surface as they move through said treatment zone, said conveyor including side wall structure extending along the opposed sides of said treatment zone throughout the length thereof, each said conveyor side wall structure including an inwardly facing vertical surface portion that extends the length of said treatment zone and is mounted for vertical reciprocatory motion with said conveyor transport surface, fixed edge structure closely adjacent each said inwardly facing vertical surface portion that defines an elongated orifice between said fixed edge structure and said vertical surface portion, and means for flowing gas through each said orifice and vertically downwardly along each said vertical side wall portion for containing particulate material within said treatment zone.

2. The system of claim 1 wherein said drive is of the oscillatory type.

3. The system of claim 1 wherein gas flowing means and said fixed edge structure comprise boundary plenum structure that has a slot in its lower wall, and the upper portion of said vertical surface portion extends through said slot into said boundary plenum.

4. The system of claim 3 wherein the material of said vertical surface portion is at least as hard as the material of said boundary plenum slot defining structure.

5. The system of claim 3 wherein said gas flowing means creates a pressure in said boundary plenum in the order of at least about one-half inch of water.

6. The system of claim 1 wherein said vertical surface portion is defined by a planar blade member that is offset outwardly from said conveyor side wall structure.

7. The system of claim 6 wherein gas flowing means and said fixed edge structure comprise boundary plenum structure that has a slot in its lower wall, and the upper edge of said planar blade remains entirely within said boundary plenum as it is driven in vertical reciprocatory motion by said drive.

8. The system of either claim 3 or 7 wherein the material of said vertical surface portion is harder than the material of said boundary plenum slot defining structure.

9. The system of claim 8 wherein said gas flowing means creates a pressure in said boundary plenum in the order of about one inch of water.

10. The system of any one of claims 1, 5, or 7 wherein the width of said elongated orifice is less than one millimeter.

* * * * *